United States Patent [19]

Fan

[11] Patent Number: 4,658,129

[45] Date of Patent: Apr. 14, 1987

[54] PHOTOELECTRIC CONTROL DEVICE WHICH DETECTS CHANGES IN LIGHT INTENSITY

[76] Inventor: Jenn-Kang Fan, No. 8, Kung Tzu Kou, 8-Lin, Jen An Li, Kuang Hsi, Hsin Tzu Hsien, Taiwan

[21] Appl. No.: 758,724

[22] Filed: Jul. 25, 1985

[51] Int. Cl.[4] ..... H05B 37/02; H05B 39/04; H05B 41/36

[52] U.S. Cl. ..... 250/214 R; 250/214 AL; 307/311; 315/158

[58] Field of Search ..... 250/206, 214 R, 214 AL; 307/117, 253 B, 311; 315/158; 323/221, 223; 328/2; 362/276

[56] References Cited

U.S. PATENT DOCUMENTS 3,176,189 3/1965 Tabet ..... 315/158

3,529,214 9/1970 Corn ..... 250/214 AL

*Primary Examiner*—Edward P. Westin

*Assistant Examiner*—Stephone Allen

*Attorney, Agent, or Firm*—Birch, Stewart, Kolasch & Birch

[57] ABSTRACT

A photoelectric control device having a photoelectric sensing unit for delivering an output voltage in response to changes of the intensity of light, the output voltage being applied to a capacitor for operating a SCR. When the output voltage reaches a predetermined level the SCR is caused to become conductive or non-conductive. The SCR is connected to a bridge rectifier which causes a triac to become conductive or non-conductive when the SCR becomes conductive or non-conductive, so as to allow electric power to be supplied to a load or to be cut off in response to changes in the intensity of light.

2 Claims, 3 Drawing Figures

PHOTOELECTRIC CONTROL DEVICE WHICH DETECTS CHANGES IN LIGHT INTENSITY

BACKGROUND OF THE INVENTION

1. FIELD OF THE INVENTION

This invention generally relates to photoelectric control devices which detect changes in the intensity of light and produce electric signals in response to changes in the intensity of light, more particularly an improved photoelectric control device provided with a photoelectric sensing unit to cooperate with a silicon-controlled rectifier and a bridge rectifier to cause a triac to become conductive or non-conductive, so as to turn on or turn off a system when the intensity of light changes from or reaches a predetermined level.

2. BRIEF DESCRIPTION OF PRIOR ART

Photoelectric control devices have been widely used in controlling various types of equipment such as automatic lighting systems. A conventional photoelectric control device PS1, as shown in FIG. 1, includes a photoelectric sensing unit P1, a switch SW1, and a load Wl to which electric power is supplied through switch SWl, wherein switch SW1 is operable with a bimetal M in association with a heater H through which photoelectric sensing unit P1 is connected to a power source E. In operation, electric current is supplied to heater H which thus generates heat to cause bimetal M of switch SW1 to warp to cause the pair of contact points S to open or close, or to cause switch SWl to turn on or to turn off. The electrical resistance of photoelectric sensing unit P1 varies with the intensity of the light received by photoelectric sensing unit P1 to cause the electric current passing through photoelectric sensing unit P1 to vary to operate switch SW1 accordingly. In this arrangement, at a certain point during the operation of switch SW1 the pair of contact points S may pause or hesitate in between the "open" position and the "closed" position when the intensity of the light changes at a relatively slow rate. Such a pausing or hesitation of the contact points S in an interim position will cause the device to function improperly. Furthermore, the operation of switch SW1 in response to changes in the intensity of light is relatively slow and inaccurate; thus its application is very limited.

Another conventional photoelectric control device PS2, as shown in FIG. 2, includes a photoelectric sensing element P2 having a capacitor C1 shunted across two ends or junctions A and B of photoelectric sensing element P2, a resistor R1 having one end connected to junction B and another end connected to terminal C; a triac T1 having a second anode connected to terminal C, a first anode connected to junction A, and a gate connected to junction B with bilateral diode thyristor D1. The photoelectric control device PS2 is connected with a load W2 in series and then connected to a power source E. In operation, the voltage at junction B varies as the intensity of the light received by photoelectric sensing element P2 changes; when the voltage at junction B decreases, for example, to a certain level, bilateral diode thyristor D1 is activated to trigger triac T1, thus causing triac T1 to become electrically conductive, so as to "turn on" load W2. On the other hand, when the voltage at junction B decreases to a certain level, bilateral diode thyristor D1 acts to "turn off" triac T1, thus "turning off" load W2. In this arrangement, the response time of the device is considerably shortened in comparison with first conventional photoelectric control device PS1 of 10 FIG. 1; however, the switching point tends to shift or vary from the preset light condition, making the switching function inaccurate.

SUMMARY OF THE INVENTION

In view of the aforesaid problems with conventional photoelectric control devices, the present invention offers an improved photoelectric control device, which includes a photoelectric sensing unit capable of delivering an output voltage in response to changes in the intensity of light, a trigger unit having a silicon-controlled rectifier (SCR) operable with the output voltage delivered by the photoelectric sensing unit to become conductive or nonconductive when such output voltage reaches a predetermined level, a first switching unit operable by the trigger unit, and a second switching unit operable by the first switching unit to turn on or turn off a load when the intensity of light changes from or reaches a predetermined level. In a preferred embodiment, the first switching unit is a bridge rectifier having a pair of first terminals connected to an A.C. power source and a pair of second terminals through which a D.C. voltage, more specifically a rectified voltage, is supplied to the photoelectric sensing unit and the trigger unit. The pair of second terminals of the bridge rectifier is connected to an anode and a cathode of the SCR, the SCR having a gate connected to a capacitor to which the output voltage from the photoelectric sensing unit is applied. The second switching unit is a triac having a first anode and a second anode connected to an A.C. power source with a load, and a gate connected to the second anode through the pair of first terminals of the bridge rectifier, or the first switching unit. When the output voltage from the photoelectric sensing unit changes from or reaches a predetermined level, the capacitor acts to cause the SCR, or the trigger unit, to become electrically conductive or non-conductive, thus allowing an A.C. voltage to pass or cutting off the supply of an A.C. voltage through the pair of first terminals of the bridge rectifier, or the first switching unit, to the gate of the triac, or the second switching unit; and as a result the triac is caused to become electrically conductive or non-conductive to turn on or turn off a load accordingly.

The photoelectric control device of this invention functions accurately regardless of the rate of the change in the intensity of light.

Therefore, it is the main object of this invention to provide an improved photoelectric control device which functions accurately under all conditions.

DETAILED DESCRIPTION OF THE INVENTION

Figure 1:
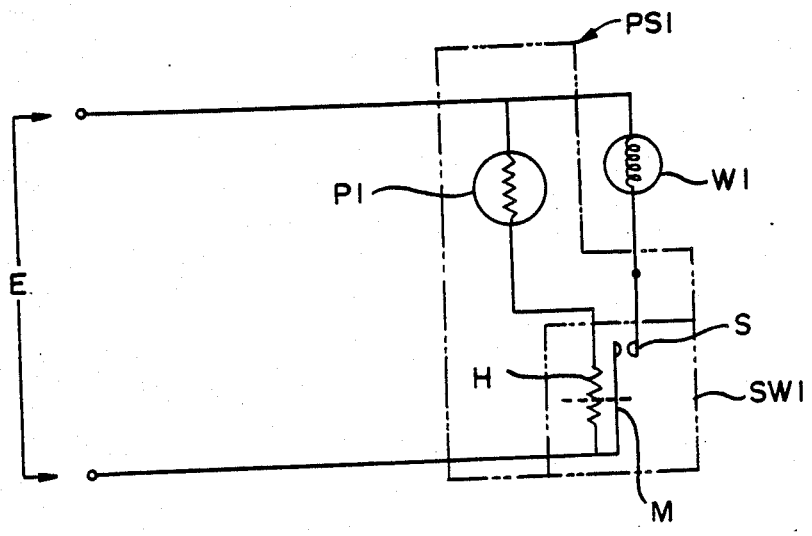
FIG. 1 PRIOR ART
FIG. 1 is an electric circuit diagram of a conventional photoelectric control device.
Figure 2:
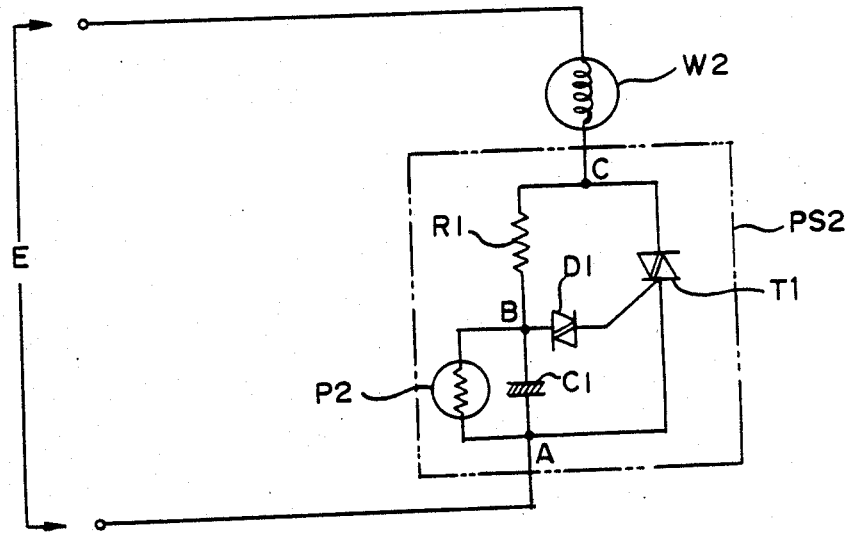
FIG. 2 PRIOR ART
FIG. 2 is an electric circuit diagram of second conventional photoelectric control device.
Figure 3:
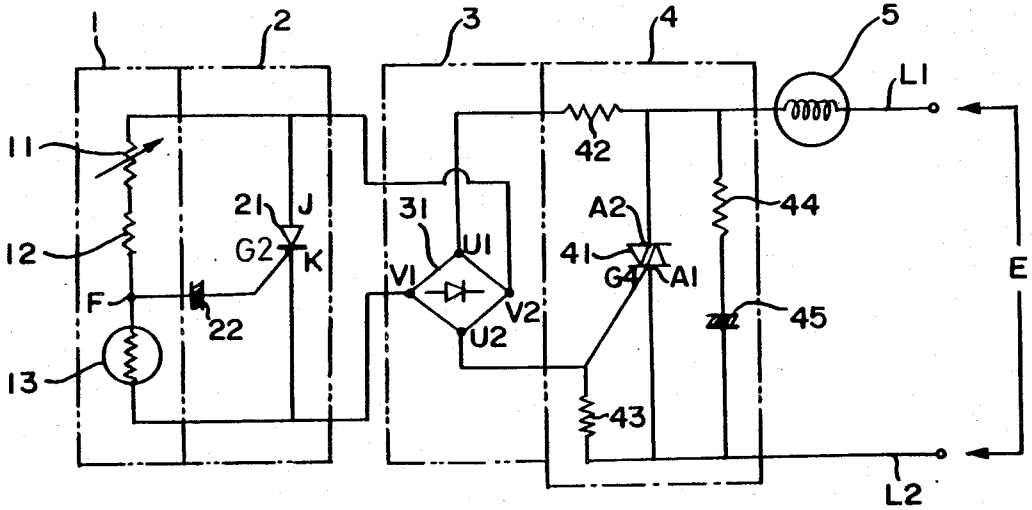
FIG. 3 is an electric circuit diagram of a preferred embodiment of the photoelectric control device of the present invention.

As shown in FIG. 3, the photoelectric control device of the present, invention includes a photoelectric sensing unit 1 (hereinafter a sensing unit) capable of delivering an output voltage in response to changes in the intensity of light, a trigger unit 2 operable by the output voltage delivered by the sensing unit 1 when the output voltage changes from or reaches a predetermined level, a first switching unit 3 capable of supplying a rectified voltage to sensing unit 1 and also operable by the trigger unit 2, a second switching unit 4 operable by first switching unit 3 for turning on and turning off a load unit 5 at a specific light intensity.

Sensing unit 1 includes a series connection of a variable resistor 11, and a resistor 12 connected to photoelectric sensing element 13 at junction F. Trigger unit 2 includes a silicon-controlled rectifier (SCR) 21 having anode J and cathode K shunted across sensing unit 1, and a gate G2 connected to junction F of photoelectric sensing element 13 and resistor 12 with a capacitor 22. First switching unit 3 includes a bridge rectifier 31 having a pair of first terminals U1 and U2 and a pair of second terminals V1 and V2, wherein the pair of first terminals U1 and U2 is connected to an A.C. power source E with resistor 42, load circuit 5, a first power line L1, resistor 43, and a second power line L2; and the pair of second terminals V1 and V2 is connected across two ends of each one of sensing unit 1 and trigger unit 2, so that a D.C. voltage, more specifically a rectified voltage is produced by first switching unit 3 and supplied to sensing unit 1 and trigger unit 2.

Second switching unit 4 includes a triac 41 having a first anode A1 connected to one of the pair of first terminal U2 of bridge rectifier 31 with resistor 43, and a second anode A2 connected to another first terminal U1 with resistor 42. Triac 41 also has a gate G4 connected to first terminal U2 of bridge rectifier 31. A series connection of resistor 44 and capacitor 45 is shunted across first anode A1 and second anode A2 of triac 41 to protect triac 41 from excessive voltage.

In operation, power lines L1 and L2 are connected to an A.C. power source E, and an A.C. voltage is applied across first anode A1 and second anode A2 of triac 41, and also across the pair of first terminals U1 and U2 of bridge rectifier 31, which in turn produces a rectified voltage, through pair of second terminals V1 and V2, to be applied across sensing unit 1, and also across trigger unit 2. A certain divisional voltage is generated at junction F to be applied to capacitor 22. Photoelectric element 13, having a resistance variable with changes in the intensity of light cast thereon, causes such a divisional voltage to vary in response to changes in the intensity of light. Assuming that the device is for the automatic switching on and off of street lights, and the intensity of the light received by the sensing element is decreasing in the twilight period; as the intensity of light decreases, the resistance of photoelectric sensing element 13 increases to cause the divisional voltage at junction F, or that being applied to capacitor 22, to increase. As soon as the divisional voltage reaches a 10 specific, predetermined level, or threshold voltage, capacitor 22 is caused to discharge, thus applying a trigger voltage to gate G2 of SCR 21 so as to "trigger" SCR 21; therefore SCR 21 becomes conductive, causing bridge rectifier 31 to also become conductive through first terminals Ul and U2. As a result an A.C. voltage is applied to gate G4 of triac 41, and triac 41 is thus "turned on" to allow electric power from source E to be supplied to load 5, which may be a relay for turning on a main switch for a group of street lights.

When the intensity of the light cast on to photoelectric sensing element 13 increases, as at dawn, the resistance of sensing element 13 decreases to cause the divisional voltage at junction F, or the voltage applied to capacitor 22, to decrease. As soon as the voltage applied to capacitor 22 decreases to a specific, predetermined level, or threshold voltage, capacitor 22 acts to cut off the voltage applied to gate G2 of SCR 21. Since the voltage supplied to anode J of SCR 21 is a rectified voltage which is a unidirectional, wavy voltage formed by converting an A.C. voltage, the SCR 21 becomes non-conductive as soon as the voltage applied to gate G2 is cut off. As a result, the voltage applied to gate G4 of triac 41 is cut off and triac 41 is "turned off", so as to cut off the supply of electric power from source E to load 5, which might be a relay for the main switch of a group of street lights.

As described above, the photoelectric control device of this invention employs a sensing unit, a trigger unit having a SCR, a first switching unit having a bridge rectifier for supplying a rectified current to the sensing unit and the trigger unit, and a second switching unit operable by the trigger unit in cooperation with the first switching unit; the device functions more accurately and efficiently and is useful in various applications other than the automatic switching of street lights, such as detecting devices for automatic packaging, and safety devices for punch press operations.

What is claimed is:

1. A photoelectric control device, comprising:

a photoelectric sensing unit capable of delivering an output voltage in response to changes of the intensity of light cast on said photoelectric sensing unit;

a trigger unit having a capacitor and a silicon controlled rectifier having a gate connected to said capacitor to which said output voltage delivered by said photoelectric sensing unit is applied;

a first switching unit capable of supplying a rectified voltage from an A.C. source to said photoelectric sensing unit and said trigger unit and operable by said trigger unit; and a second switching unit operable by said trigger unit in cooperation with said first switching unit when said output voltage varies and reaches a predetermined level, second to selectively allow or cut off the supply of electric current.

2. A photoelectric control device as recited in claim 1, wherein said first switching unit is a bridge rectifier having a pair of first terminals adapted to be connected to an A.C. power source, and a pair of second terminals from which said rectified voltage is delivered to said trigger unit and said photoelectric sensing unit; and said second switching unit is a triac operatively connected to said bridge rectifier.

* * * * *